United States Patent [19]

Gannaway

[11] Patent Number: 4,842,492

[45] Date of Patent: Jun. 27, 1989

[54] COMPRESSOR DISCHARGE MUFFLER HAVING COVER PLATE

[75] Inventor: Edwin L. Gannaway, Adrian, Mich.

[73] Assignee: Tecumseh Products Company, Tecumseh, Mich.

[21] Appl. No.: 148,073

[22] Filed: Jan. 25, 1988

[51] Int. Cl.[4] ..... F04B 11/00

[52] U.S. Cl. ..... 417/312; 417/523; 417/540; 417/902; 62/296

[58] Field of Search ..... 417/273, 312, 369, 523, 417/540, 541, 542, 543, 902; 62/296

[56] References Cited

U.S. PATENT DOCUMENTS

| | | | |
|---|---|---|---|
| 2,578,785 | 12/1951 | Davis . | |
| 2,963,218 | 12/1960 | Tower . | |
| 3,807,907 | 4/1974 | Gannaway . | |
| 4,431,383 | 2/1984 | Boehmier et al. . | |
| 4,470,772 | 9/1984 | Gannaway . | |
| 4,569,645 | 2/1986 | Asami et al. | 417/902 X |
| 4,623,304 | 11/1986 | Chikada et al. | 417/902 X |
| 4,645,429 | 2/1987 | Asami et al. | 417/902 X |

*Primary Examiner*—Carlton R. Croyle
*Assistant Examiner*—Eugene L. Szczecina, Jr.
*Attorney, Agent, or Firm*—Albert L. Jeffers; John F. Hoffman; David L. Ahlersmeyer

[57] ABSTRACT

A hermetically sealed scotch yoke compressor assembly is disclosed wherein a crankcase includes annular channels formed on the top and bottom surfaces thereof defining muffling chambers. Gas refrigerant compressed within radially disposed cylinders into cylinder head covers is channeled into the upper annular muffler chamber and them through passages extending through the crankcase into the lower muffling chamber. An annular cover plate for covering the bottom annular channel is attached to the crankcase at its radially inner extreme and is biased against the crankcase at its radially outer extreme. Spacers between the cover plate and the crankcase provide an annular discharge opening directing discharge gas onto the motor windings.

19 Claims, 4 Drawing Sheets

COMPRESSOR DISCHARGE MUFFLER HAVING COVER PLATE

BACKGROUND OF THE INVENTION

The present invention relates generally to a hermetic compressor assembly and, more particularly, to such a compressor assembly wherein pressurized gas refrigerant is directed through at least one muffling chamber prior to being discharged into the interior of the hermetically sealed housing in the vicinity of the motor windings for cooling thereof.

In general, prior art compressor assemblies of the type to which the present invention relates, comprise a housing which is hermetically sealed. Located within the housing are an electric motor and a compressor mechanism. The electric motor is connected to a crankshaft which has an eccentric portion thereon. In the case of a scotch yoke reciprocating piston compressor, the eccentric portion of the crankshaft is located within a suction cavity defined by a crankcase. Low pressure suction gas is delivered directly to the suction cavity and is compressed in radially disposed cylinders by means of piston valve assemblies reciprocably disposed therein. Gas refrigerant compressed within the cylinder is discharged through discharge ports and valves associated with a valve plate mounted to the outside of the crankcase to close off the cylinders. The discharge gas then typically enters a cylinder head cover mounted on top of the valve plate and defining a discharge space therein. From the discharge space defined by the valve plate and the cylinder head cover, the gas is routed through a muffling system to reduce noise pulsations produced by the reciprocating nature of the compressor and associated valving.

In prior art hermetically sealed scotch yoke compressor assemblies, the interior of the housing is typically at low suction pressure and, therefore, pressurized discharge gas exiting the cylinder head cover is directed through a muffler and then discharged outside of the housing. In such a configuration, a discharge muffler may take the form of a multi-piece annular muffler assembly mounted to, but not integral with, the compressor crankcase. A disadvantage of such a system is not only the complexity associated with assembling such a structure but also the need for interconnecting tubing from the cylinder head cover to the muffler and from the muffler to the exterior of the housing.

Another prior art design for a discharge muffler in a multi-cylinder scotch yoke compressor is the provision of a generally annular cavity in the bottom surface of the crankcase adjacent the oil sump and opposite the drive motor. A cover for the cavity in this design takes the form of a structure incorporating a crankshaft bearing and an oil pump. This particular prior art discharge muffler system further requires that discharge tubing connect into the annular cavity and communicate with the exterior of the housing.

Disadvantages of the aforementioned prior art muffling systems include the lack of provision for a two-stage muffler for a scotch yoke reciprocating piston compressor. Furthermore, the prior art systems are not entirely applicable to a compressor assembly having a pressurized housing into which discharge gas is released. More specifically, none of the prior art discharge muffler systems provides for effective cooling of the motor windings adjacent the compressor crankcase.

SUMMARY OF THE INVENTION

The present invention overcomes the disadvantages of the above-described prior art muffler systems for scotch yoke compressor assemblies by providing an improved muffling system for directing gas from within the cylinder head cover through an annular discharge muffler chamber having a cover plate that directs the discharge gas toward the motor windings for cooling thereof.

Generally, the invention provides, in one form thereof, a compressor assembly comprising a hermetically sealed pressurized housing, a compressor assembly within the housing including a crankcase, an annular channel formed in the outside surface of the crankcase into which compressed gas is discharged, and a cover plate associated with the annular channel to define an annular muffling chamber and to allow for release of discharge gas from within the muffling chamber to the housing interior.

More specifically, the invention provides, in one form thereof, a two-stage muffler system for a hermetically sealed scotch yoke compressor assembly wherein a first muffling chamber and a second muffling chamber are located on respective opposite axial ends of the compressor crankcase. Gas passages extend through the crankcase for providing communication between the first and second muffling chambers. Accordingly, compressed gas discharged from cylinders within the compressor crankcase is directed into a first annular muffling chamber, and then proceeds through passageways in the crankcase to the second annular muffling chamber before being discharged into the housing. The second discharge chamber may be positioned adjacent the drive motor to provide cooling thereof upon release of compressed discharge gas into the housing interior. To this end, the cover plate for the annular channel formed in the crankcase adjacent the motor is attached so as to provide an annular space permitting for release of the discharge gas. In one form of the present invention, attachment of the cover plate to the crankcase is accomplished by attachment at one radially extreme and by biased engagement at the other radial extreme.

An advantage of the muffler system of the present invention is that a simple, inexpensive cover plate is provided for an annular chamber formed in a compressor crankcase.

Another advantage of the discharge muffler system of the present invention is that two-stage muffling is provided for greater noise reduction.

A still further advantage of the discharge muffler according to the present invention is the provision of an annular exhaust port adjacent the motor windings for 360° expulsion of the discharge gas from the second muffling stage directed toward the motor windings.

Yet another advantage of the discharge muffler cover plate of the present invention is the ease of assembly wherein mounting of the cover plate to the crankcase is performed at only one circumferential edge of the cover plate.

Another advantage of the discharge muffler according to the present invention is that less material is required by providing annular chambers integral with the crankcase.

Yet another advantage of the discharge muffler according to the present invention is that a discharge muffler stage is provided with a minimum number of parts.

A still further advantage of the discharge muffler in accordance with the present invention is that the annular chamber in the crankcase is spaced from the rotating shaft, thereby obviating the need for a slip fit or journalled fit between the muffler and the crankshaft.

The compressor assembly of the present invention, in one form thereof, provides a hermetically sealed housing defining a discharge space therein. A crankcase is also provided within the housing including a plurality of radially disposed cylinders formed therein. The crankcase also includes a cavity into which the plurality of cylinders open. A crankshaft is rotatably received in the crankcase and has a plurality of pistons operably connected thereto within the cavity. The pistons are operably received in respective cylinders to compress gaseous refrigerant received therein. A first muffling chamber and a second muffling chamber are located on respective opposite axial ends of the crankcase. Gas passage means extend through the crankcase and provide communication between the first muffling chamber and the second muffling chamber. Means are also provided for discharging gaseous refrigerant compressed within the cylinders into the first muffling chamber. Also, means are provided for exhausting gaseous refrigerant from the second muffling chamber into the discharge pressure space.

There is further provided, in one form of the present invention, a compressor assembly comprising a hermetically sealed housing having a discharge pressure space therein. An electric motor is operatively disposed within the housing and has a rotatable rotor. A crankcase within the housing includes a plurality of radially disposed cylinders formed therein. The crankcase also includes a cavity into which the plurality of cylinders opens. Furthermore, a crankshaft is rotatably connected to the rotor and is operably journalled in the crankcase. The crankshaft has a plurality of pistons operably connected thereto within the cavity, the pistons being operably received in respective cylinders to compress gaseous refrigerant received therein. An annular channel is formed in the crankcase on the outer surface thereof adjacent the motor. The channel comprises a radially inner wall and a radially outer wall, each wall having an outwardly facing top surface. Means are provided for discharging gaseous refrigerant compressed within the cylinders into the channel. A channel cover plate is provided, as well as means for attaching the cover plate to the crankcase at the top surface of one of the inner and outer walls such that the cover plate is biased in engagement with the top surface of the other wall.

The compressor assembly of the present invention further provides, in one form thereof, a hermetically sealed housing having a discharge pressure space therein, the housing having a top end and a bottom end in its operative position. A crankcase is mounted within the housing and has a top surface and a bottom surface facing the respective top and bottom ends of the housing. The crankcase includes a plurality of radially disposed cylinders formed therein. The crankcase also includes an inner cavity into which the plurality of cylinders open. An electric motor is operatively disposed within a housing below the crankcase and has a stator winding and a rotatable rotor. A vertical crankshaft operably journalled in the crankcase extends from the bottom surface thereof to rotatably connect with the rotor. The crankshaft has a plurality of pistons operably connected thereto within the cavity. Furthermore, the pistons are operably received in respective cylinders to compress gaseous refrigerant received therein. A first muffling chamber is provided on the top surface of the crankcase. Means are provided for discharging gaseous refrigerant compressed within the plurality of cylinders into the first muffling chamber. An annular channel formed in the bottom surface of the crankcase surrounds the crankshaft and comprises a radially inner wall, a radially outer wall, and a bottom wall. The crankcase bottom surface has an inner annular ledge adjacent to and extending radially inwardly from the inner wall. The crankcase bottom surface also has an outer annular ledge adjacent to and extending radially outwardly from the outer wall. Gas passage means extend through the crankcase providing communication between the first muffling chamber and the annular channel. A ring-shaped channel cover plate is provided, as well as means for attaching the cover plate to the bottom surface of the crankcase. Attachment of the cover plate to the crankcase is such that the cover plate is fixedly mounted against the inner ledge while being biased in engagement with the outer ledge. The attachment means also includes a plurality of circumferentially spaced spacers interposed between the cover plate and the inner ledge. Accordingly, a substantially unimpeded annular port is provided for exhausting gaseous refrigerant from the second channel into the discharge pressure space adjacent the motor stator winding for cooling thereof.

DESCRIPTION OF THE PREFERRED EMBODIMENT

Figure 1:
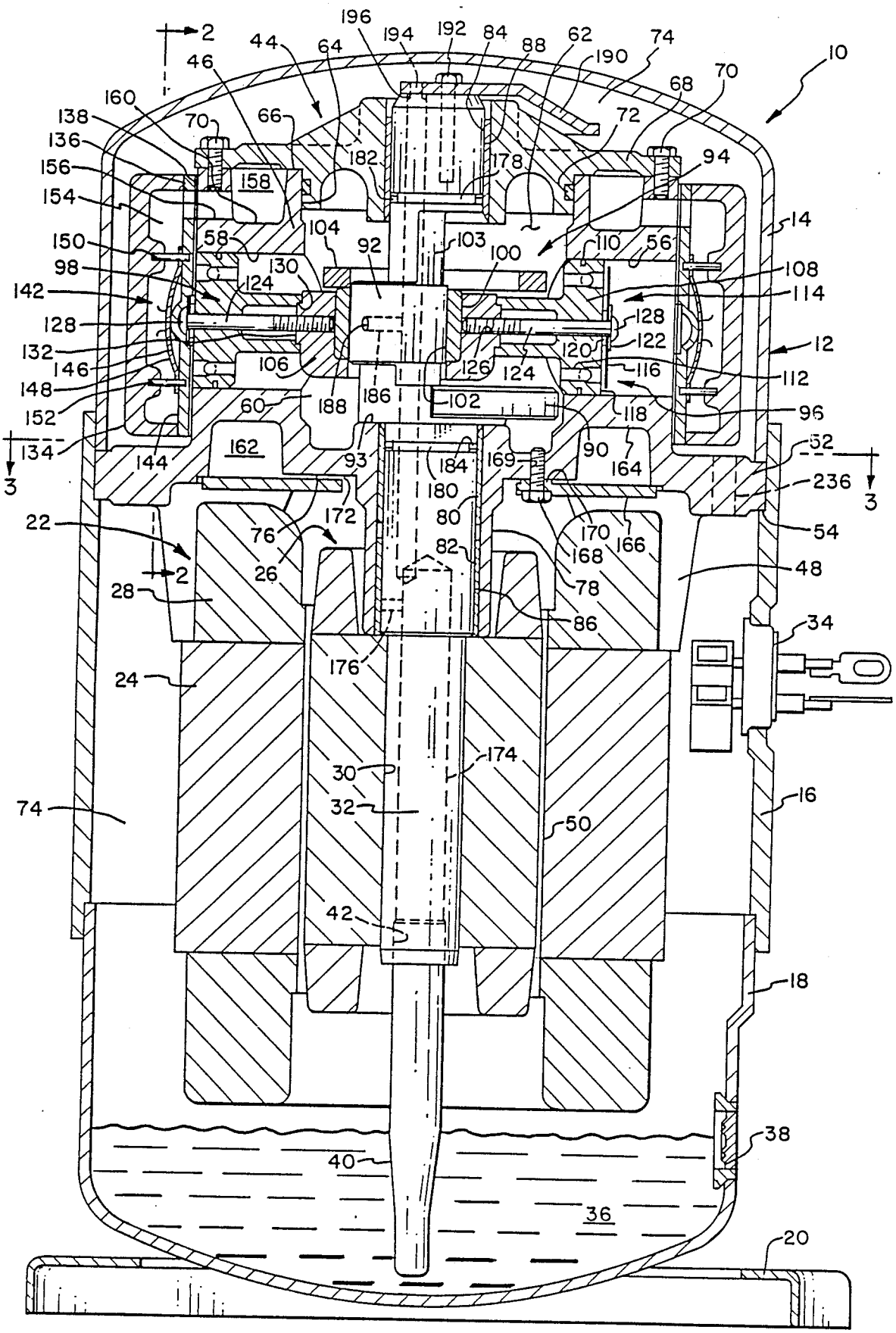
FIG. 1 is a side sectional view of a compressor of the type to which the present invention pertains.

In an exemplary embodiment of the invention as shown in the drawings, and in particular by referring to FIG. 1, a compressor assembly 10 is shown having a housing generally designated at 12. The housing has a top portion 14, a central portion 16, and a bottom portion 18. The three housing portions are hermetically secured together as by welding or brazing. A mounting flange 20 is welded to the bottom portion 18 for mounting the compressor in a vertically upright position. Located within hermetically sealed housing 12 is an electric motor generally designated at 22 having a stator 24 and a rotor 26. The stator is provided with windings 28. Rotor 26 has a central aperture 30 provided therein into which is secured a crankshaft 32 by an interference fit. A terminal cluster 34 is provided in central portion 16 of housing 12 for connecting the compressor to a source of electric power. Where electric motor 22 is a three-phase motor, bidirectional operation of compressor assembly 10 is achieved by changing the connection of power at terminal cluster 34.

Compressor assembly 10 also includes an oil sump 36 located in bottom portion 18. An oil sight glass 38 is provided in the sidewall of bottom portion 18 to permit viewing of the oil level in sump 36. A centrifugal oil pick-up tube 40 is press fit into a counterbore 42 in the end of crankshaft 32. Oil pick-up tube 40 is of conventional construction and includes a vertical paddle (not shown) enclosed therein.

Also enclosed within housing 12, in the embodiment of FIG. 1, is a compressor mechanism generally designated at 44. Compressor mechanism 44 comprises a crankcase 46 including a plurality of mounting lugs 48 to which motor stator 24 is attached such that there is an annular air gap 50 between stator 24 and rotor 26. Crankcase 46 also includes a circumferential mounting flange 52 axially supported within an annular ledge 54 in central portion 16 of the housing. A bore 236 extends through flange 52 to provide communication between the top and bottom ends of housing 12 for return of lubricating oil and equalization of discharge pressure within the entire housing interior.

Compressor mechanism 44, as illustrated in the preferred embodiment, takes the form of a reciprocating piston, scotch yoke compressor. More specifically, crankcase 46 includes four radially disposed cylinders, two of which are shown in FIG. 1 and designated as cylinder 56 and cylinder 58. The four radially disposed cylinders open into and communicate with a central suction cavity 60 defined by inside cylindrical wall 62 in crankcase 46. A relatively large pilot hole 64 is provided in a top surface 66 of crankcase 46. Various compressor components, including the crankshaft, are assembled through pilot hole 64. A top cover such as cage bearing 68 is mounted to the top surface of crankcase 46 by means of a plurality of bolts 70 extending through bearing 68 into top surface 66. When bearing 68 is assembled to crankcase 46, an O-ring seal 72 isolates suction cavity 60 from a discharge pressure space 74 defined by the interior of housing 12.

Crankcase 46 further includes a bottom surface 76 and a bearing portion 78 extending therefrom. Retained within bearing portion 78, as by press fitting, is a sleeve bearing assembly comprising a pair of sleeve bearings 80 and 82. Two sleeve bearings are preferred rather than a single longer sleeve bearing to facilitate easy assembly into bearing portion 78. Likewise, a sleeve bearing 84 is provided in cage bearing 68, whereby sleeve bearings 80, 82, and 84 are in axial alignment. Sleeve bearings 80, 82, and 84 are manufactured from steel-backed bronze.

A sleeve bearing, as referred to herein, is defined as a generally cylindrical bearing surrounding and providing radial support to a cylindrical portion of a crankshaft, as opposed to a thrust bearing which provides axial support for the weight of the crankshaft and associated parts. A sleeve bearing, for example, may comprise a steel-backed bronze sleeve insertable into a crankcase, or a machined cylindrical surface made directly in the crankcase casting or another frame member.

Referring once again to crankshaft 32, there is provided thereon journal portions 86 and 88, wherein journal portion 86 is received within sleeve bearings 80 and 82, and journal portion 88 is received within sleeve bearing 84. Accordingly, crankshaft 32 is rotatably journalled in crankcase 46 and extends through a suction cavity 60. Crankshaft 32 includes a counterweight portion 90 and an eccentric portion 92 located opposite one another with respect to the central axis of rotation of crankshaft 32 to thereby counterbalance one another. The weight of crankshaft 32 and rotor 26 is supported on thrust surface 93 of crankcase 46.

Eccentric portion 92 is operably coupled by means of a scotch yoke mechanism 94 to a plurality of reciprocating piston assemblies corresponding to, and operably disposed within, the four radially disposed cylinders in crankcase 46. As illustrated in FIG. 1, piston assemblies 96 and 98, representative of four radially disposed piston assemblies operable in compressor assembly 10, are associated with cylinders 56 and 58, respectively.

Scotch yoke mechanism 94 comprises a slide block 100 including a cylindrical bore 102 in which eccentric portion 92 is journalled. In the preferred embodiment, cylindrical bore 102 is defined by a steel backed bronze sleeve bearing press fit within slide block 100. A reduced diameter portion 103 in crankshaft 32 permits easy assembly of slide block 100 onto eccentric portion 92. Scotch yoke mechanism 94 also includes a pair of yoke members 104 and 106 which cooperate with slide block 100 to convert orbiting motion of eccentric portion 92 to reciprocating movement of the four radially disposed piston assemblies. For instance, FIG. 1 shows yoke member 106 coupled to piston assemblies 96 and 98, whereby when piston assembly 96 is at a bottom dead center (BDC) position, piston assembly 98 will be at a top dead center (TDC) position.

Referring once again to piston assemblies 96 and 98, each piston assembly comprises a piston member 108 having an annular piston ring 110 to allow piston member 108 to reciprocate within a cylinder to compress gaseous refrigerant therein. Suction ports 112 extending through piston member 108 allows suction gas within suction cavity 60 to enter cylinder 56 on the compression side of piston 108.

A suction valve assembly 114 is also associated with each piston assembly, and will now be described with respect to piston assembly 96 shown in FIG. 1. Suction valve assembly 116 comprises a flat, disk-shaped suction valve 116 which in its closed position covers suction ports 112 on a top surface 118 of piston member 108. Suction valve 116 opens and closes by virtue of its own inertia as piston assembly 96 reciprocates in cylinder 56. More specifically, suction valve 116 rides along a cylindrical guide member 120 and is limited in its travel to an open position by an annular valve retainer 122.

As illustrated in FIG. 1, valve retainer 122, suction valve 116, and guide member 120 are secured to top surface 118 of piston member 108 by a threaded bolt 124 having a buttonhead 128. Threaded bolt 124 is received within a threaded hole 126 in yoke member 106 to secure piston assembly 96 thereto. As shown with respect to the attachment of piston assembly 98 to yoke member 106, an annular recess 130 is provided in each piston member and a complementary boss 132 is provided on the corresponding yoke member, whereby boss 132 is received within recess 130 to promote positive, aligned engagement therebetween.

Compressed gas refrigerant within each cylinder is discharged through discharge ports in a valve plate. With reference to cylinder 58 in FIG. 1, a cylinder head cover 134 is mounted to crankcase 46 with a valve plate 136 interposed therebetween. A valve plate gasket 138 is provided between valve plate 136 and crankcase 46. Valve plate 136 includes a coined recess 140 into which buttonhead 128 of threaded bolt 124 is received when piston assembly 98 is positioned at top dead center (TDC).

A discharge valve assembly 142 is situated on a top surface 144 of valve plate 136. Generally, compressed gas is discharged through valve plate 136 past an open discharge valve 146 that is limited in its travel by a discharge valve retainer 148. Guide pins 150 and 152 extend between valve plate 136 and cylinder head cover 134, and guidingly engage holes in discharge valve 146 and discharge valve retainer 148 at diametrically opposed locations therein. Valve retainer 148 is biased against cylinder head cover 134 to normally retain discharge valve 146 against top surface 144 at the diametrically opposed locations. However, excessively high mass flow rates of discharge gas or hydraulic pressures caused by slugging may cause valve 146 and retainer 148 to be guidedly lifted away from top surface 144 along guide pins 150 and 152.

Figure 2:
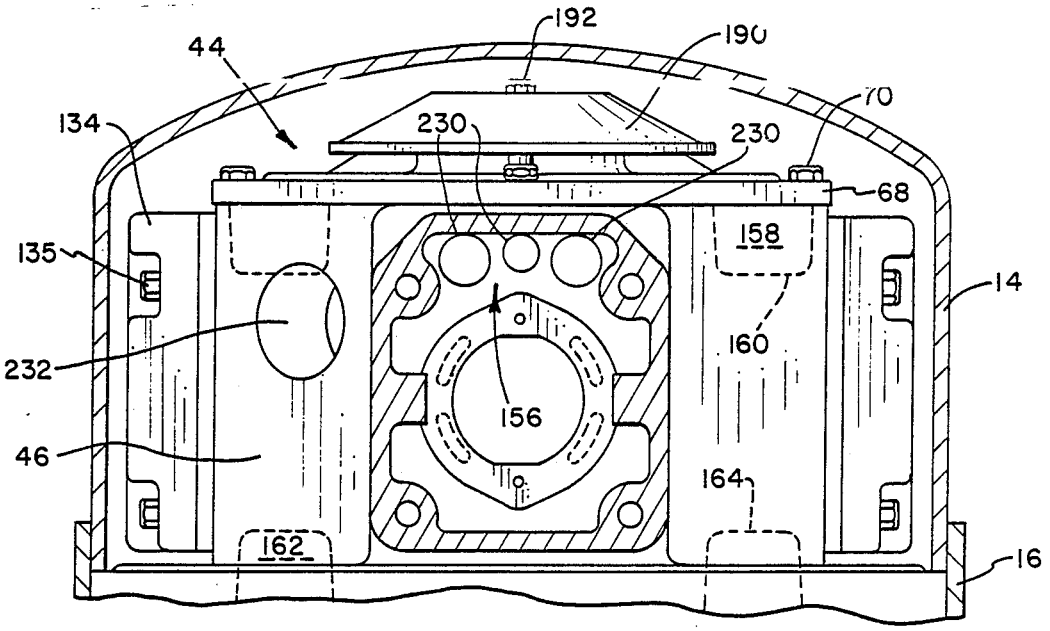
FIG. 2 is a fragmentary sectional view of the compressor of FIG. 1 taken along the line 2—2 in FIG. 1 and viewed in the direction of the arrows.

Referring once again to cylinder head cover 134, a discharge space 154 is defined by the space between top surface 144 of valve plate 136 and the underside of cylinder head cover 134 Cover 134 is mounted about its perimeter to crankcase 46 by a plurality of bolts 135, shown in FIG. 2. Discharge gas within discharge space 154 associated with each respective cylinder passes through a respective connecting passage 156, thereby providing communication between discharge space 154 and a top annular muffling chamber 158. Chamber 158 is defined by an annular channel 160 formed in top surface 66 of crankcase 46, and cage bearing 68. As illustrated, connecting passage 156 passes not only through crankcase 46, but also through holes in valve plate 136 and valve plate gasket 138.

Figure 5:
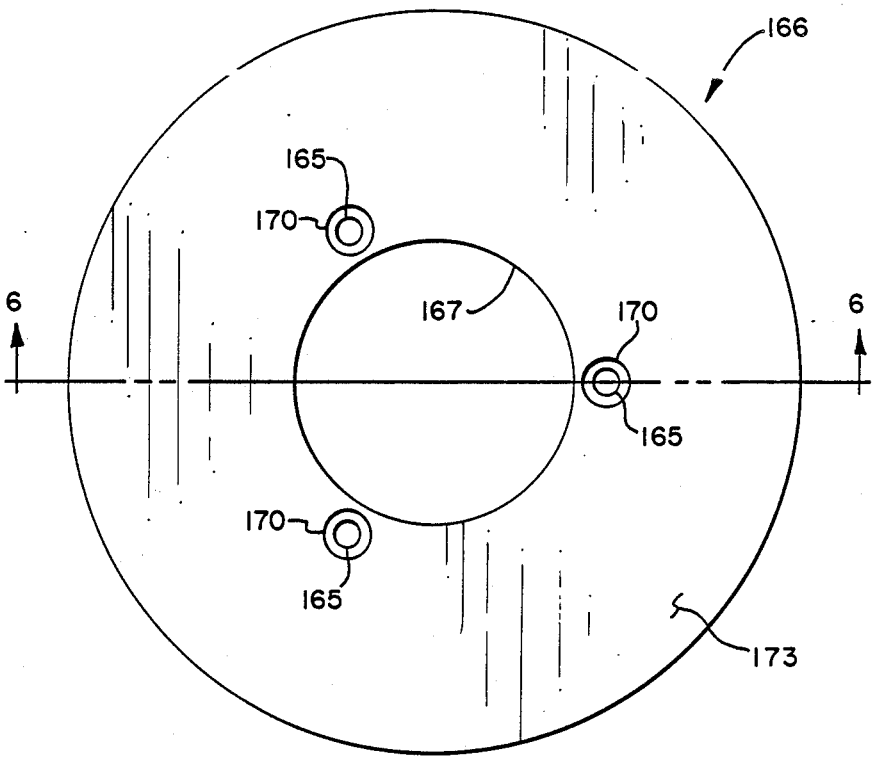
FIG. 5 is an enlarged front view of a muffler cover plate of the compressor of FIG. 1, in accord with the present invention.
Figure 6:
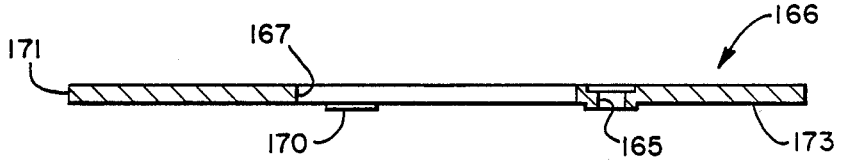
FIG. 6 is a sectional view of the muffler cover plate of FIG. 5 taken along the line 6—6 in FIG. 5 and viewed in the direction of the arrows.
Figure 7:
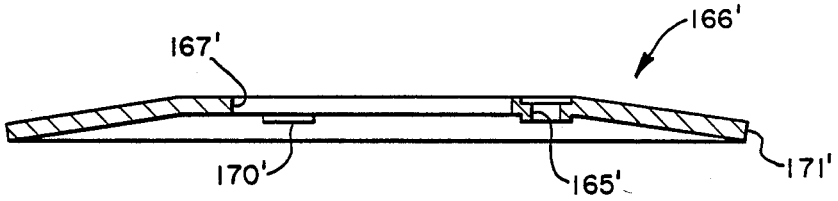
FIG. 7 is a sectional view similar to FIG. 6 of an alternative embodiment of the muffler cover plate of FIG. 5.

Top muffling chamber 158 communicates with a bottom muffling chamber 162 by means of passageways 234 extending through crankcase 46. Chamber 162 is defined by an annular channel 164 and a muffler cover plate 166. Cover plate 166, as shown in FIGS. 5 and 6 in accord with a preferred embodiment of the present invention, is an annular metal plate including three circumferentially spaced holes 165 extending therethrough at a radially inward circumferential portion 167 of plate 166. In an alternative embodiment of the present invention, cover plate 166 may take the form of a bellville washer, as illustrated in FIG. 7. Cover plate 166 is mounted against bottom surface 76 at the location of holes 165 by bolts 168 extending therethrough and into threaded holes 169 (FIG. 3) in the crankcase. Bolts 168 may also take the form of rivets or the like.

A plurality of spacers 170, each associated with a respective hole 165 and bolt 168, space cover plate 166 from bottom surface 76 approximately 0.050 inches at inward portion 167 of cover plate 166 to form an annular exhaust port 172. Spacers 170 may take the form of an annular boss integral with plate 166 and associated with each hole 165 on an outer face 173 of plate 166. Alternatively, spacers 170 may comprise separate washers interposed between plate 166 and bottom surface 76 through which bolts 168 extend. A radially outward circumferential portion 171 of cover plate 166 is biased in engagement with bottom surface 76 to prevent escape of discharge gas from within bottom muffling chamber 162 at this radially outward location.

Compressor assembly 10 of FIG. 1 also includes a lubrication system associated with oil pick-up tube 40 previously described. Oil pick-up tube 40 acts as an oil pump to pump lubricating oil from sump 36 upwardly through an axial oil passageway 174 extending through crankshaft 32. An optional radial oil passageway 176 communicating with passageway 174 may be provided to initially supply oil to sleeve bearing 82. The disclosed lubrication system also includes annular grooves 178 and 180 formed in crankshaft 32 at locations along the crankshaft adjacent opposite ends of suction cavity 60 within sleeve bearings 80 and 84. Oil is delivered into annular grooves 178, 180 behind annular seals 182, 184, respectively retained therein. Seals 182, 184 prevent high pressure gas within discharge pressure space 74 in the housing from entering suction cavity 60 past sleeve bearings 84 and 80, 82, respectively. Also, oil delivered to annular grooves 178, 180 behind seals 182 and 184 lubricate the seals as well as the sleeve bearings.

Another feature of the disclosed lubrication system of compressor assembly 10 in FIG. 1, is the provision of a pair of radially extending oil ducts 186 from axial oil passageway 174 to a corresponding pair of openings 188 on the outer cylindrical surface of eccentric portion 92.

A counterweight 190 is attached to the top of shaft 32 by means of an off-center mounting bolt 192. An extruded hole 194 through counterweight 190 aligns with axial oil passageway 174, which opens on the top of crankshaft 32 to provide an outlet for oil pumped from sump 36. An extruded portion 196 of counterweight 190 extends slightly into passageway 174 which, together with bolt 192, properly aligns counterweight 190 with respect to eccentric portion 92.

Referring now to FIG. 2, an upper portion of compressor mechanism 44 is shown to better illustrate the discharge muffling system in accord with the present invention. More specifically, FIG. 2 further shows connecting passage 156 of FIG. 1 as comprising a plurality of bores 230, associated with each radially disposed cylinder arrangement, to connect between discharge space 154 within cylinder head cover 134 and top muffling chamber 158. Also shown in FIGS. 2 and 3 is a suction inlet opening 232 included in crankcase 46, providing communication between the outside of the crankcase and suction cavity 60 defined therein.

Figure 3:
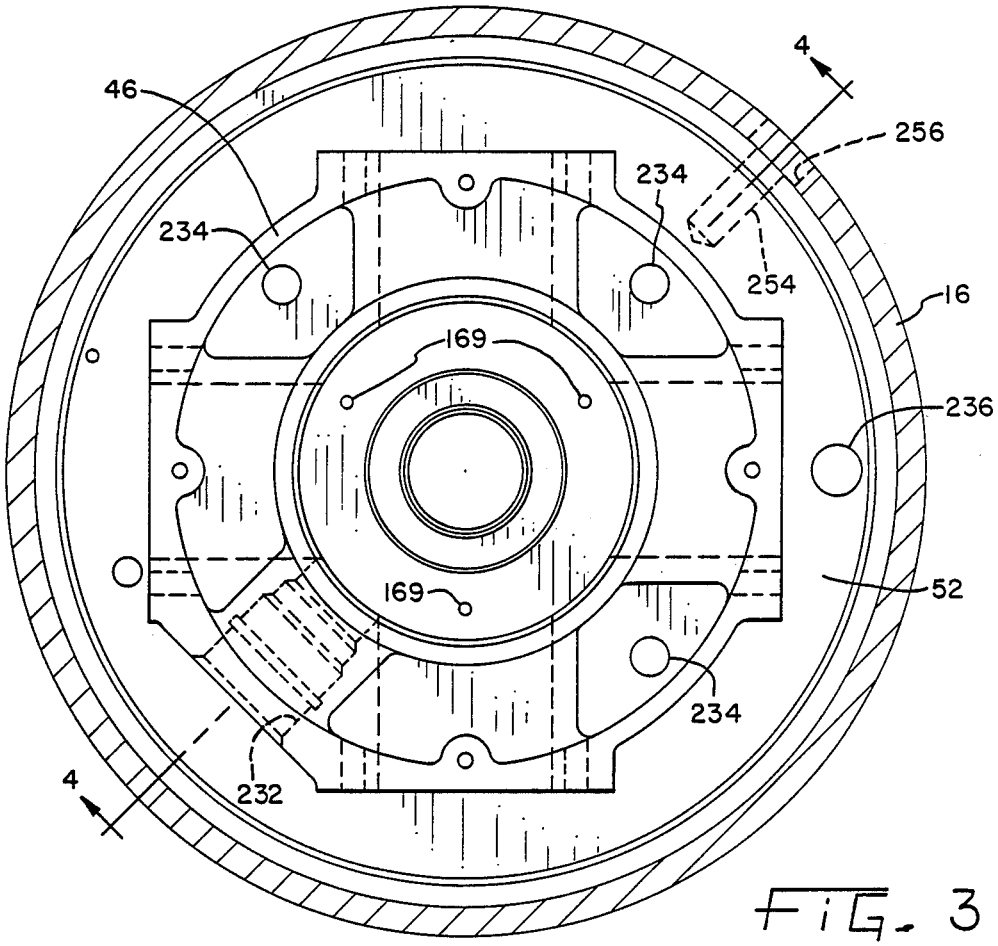
FIG. 3 is a top view of the crankcase of the compressor of FIG. 1, showing a sectional view of the housing taken along the line 3—3 in FIG. 1 and viewed in the direction of the arrows.
Figure 4:
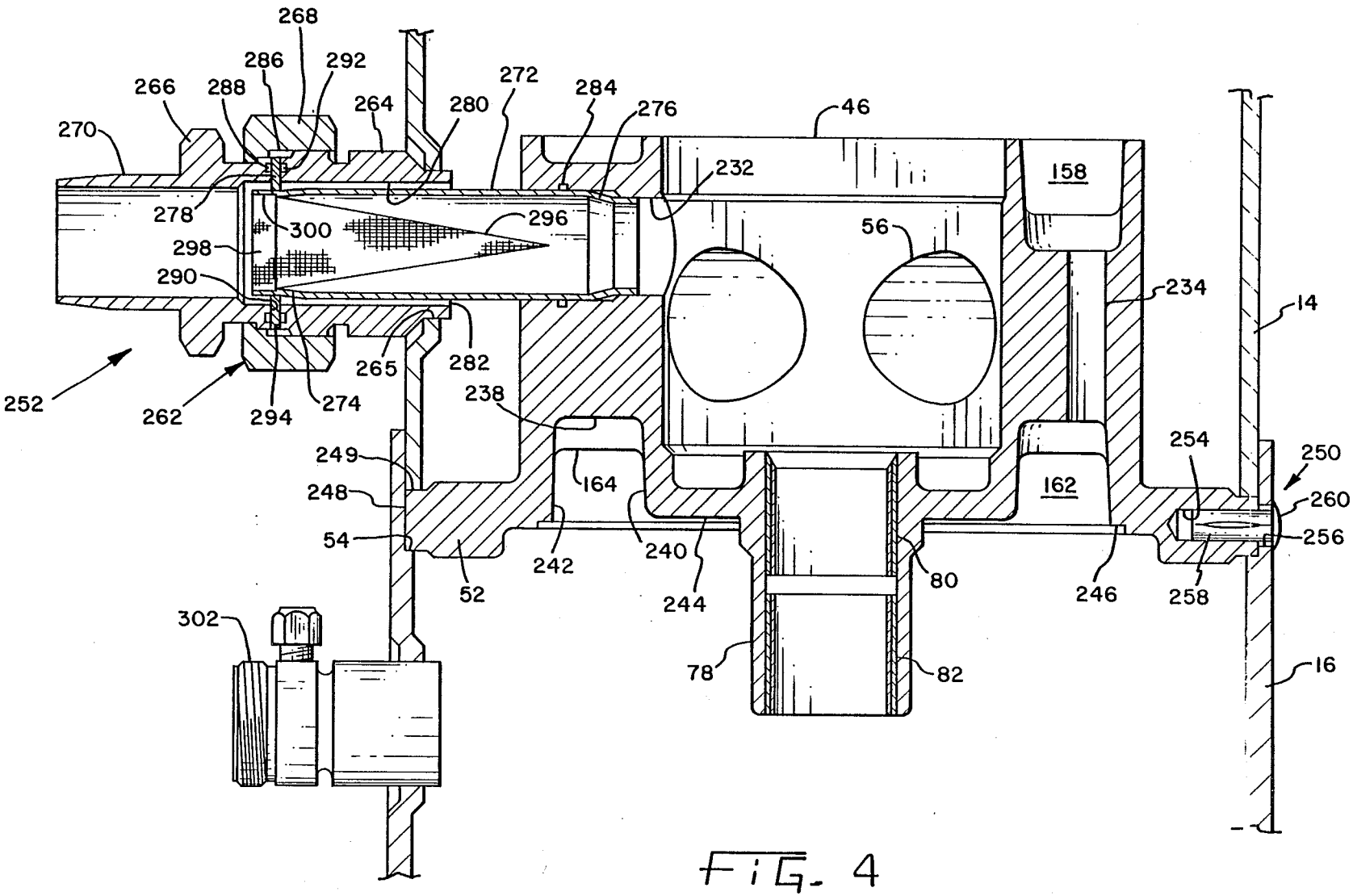
FIG. 4 is a fragmentary sectional view of the crankcase and housing assembly of FIG. 3 taken along the line 4—4 in FIG. 3 and viewed in the direction of the arrows with portions removed to better illustrate the crankcase structure.

FIGS. 3 and 4 provide views of the crankcase showing three gas passageways 234 extending through crankcase 46 at circumferentially spaced locations between cylinders to provide communication between top muffling chamber 158 and bottom muffling chamber 162. In the preferred embodiment, the combined cross-sectional area of gas passageways 234 is made approximately equal to that of bores 230 associated with one cylinder to avoid pressure drops.

Referring now to FIG. 4, gas passageways 234 open into annular channel 164 comprising a bottom wall 238, a radially inner sidewall 240, and a radially outer sidewall 242. Bottom wall 238 extends to a greater depth between adjacent cylinders and is necessarily shallower at the location of each cylinder. It is also noted that annular channel 164 circumscribes bearing portion 78 in which crankshaft 32 is journalled.

Bottom surface 76 of crankcase 46 is provided with an inner annular ledge 244 and an outer annular ledge 246 comprising the adjacent top surfaces of inner sidewall 240 and outer sidewall 242, respectively. Referring to the combination of FIGS. 1 and 4–7, inward portion 167 of cover plate 166 is fixedly attached to inner ledge 244 in cantilever fashion by means of three bolts 168 engaging crankcase 46 in threaded holes 169. The radially outward portion 171 of cover plate 166 is biased in engagement with outer ledge 246. Two exemplary methods of effecting such a biased condition are as follows. First, where cover plate 166 is substantially flat, as illustrated in FIG. 6, inner ledge 244 may be in a recessed, parallel offset plane with respect to outer ledge 246. The degree to which inner ledge 244 is recessed depends upon the thickness of spacers 170 and the amount of force necessary at the outermost portion of cover plate 166 to provide a tight seal and prevent rattling of the cover plate against outer ledge 246. Second, the outward portion 171 of cover plate 166 may be maintained in biased engagement against outer ledge 246 by making cover plate 166 dish-shaped, such as a bellville washer, as shown in FIG. 7. In this arrangement, inner ledge 244 and outer ledge 246 may be substantially coplanar.

As previously described, mounting flange 52 is axially supported within annular ledge 54. The outside diameter of flange 52 is spaced slightly from central portion 16 at annulus 248 to prevent binding when expansion and contraction of the housing occurs due to pressure and temperature conditions. Also, there is planar contact between top portion 14 and flange 52 at 249. Preferably, a clamping force at 249 is avoided so as to reduce stresses and associated noise.

A single mounting pin assembly 250 is provided diametrically opposed 180° from a suction fitting assembly 252. Mounting pin assembly 250 comprises a radially outwardly opening hole 254 in flange 52. An aperture 256 in substantial alignment with hole 254 is provided in central portion 16 of the housing. A notched pin 258 is frictionally engaged within hole 254 and extends into aperture 256. A weld is made between pin 258 and central portion 16 at aperture 256, represented in FIG. 4 by weldment 260.

Referring now to suction fitting assembly 252, there is provided a housing fitting assembly 262 comprising a housing fitting member 264, a removable outer fitting member 266, and a threaded nut 268. Housing fitting member 264 is received within an aperture 265 in top portion 14 of the housing, and is sealingly attached thereto as by welding, brazing, soldering, or the like. Outer member 266 includes a nipple 270 over which suction tubing of a refrigeration system may be received and brazed or soldered thereto. Threaded nut 268 is rotatable, yet axially retained, on outer fitting member 266.

Suction fitting assembly 252 further includes a suction tube insert 272 comprising a short length of cylindrical tubing having a first end 274 and a second end 276. A ring-like flange 278, such as a washer, is secured to the outside diameter of end 274 and extends radially outwardly therefrom. Flange 278 is secured to end 274 by means of brazing or welding. Housing fitting assembly 262, and particularly housing member 264 and outer member 266, includes a fitting bore 280 in which suction tube insert 272 axially resides. More specifically, the diameter of insert 272 is less than the diameter of bore 280 such that an annular clearance 282 is provided therebetween. In the preferred embodiment, clearance 282 is 0.050 inches circumferentially about insert 272.

During the design and manufacture of the compressor of the disclosed embodiment, it is anticipated that suction inlet opening 232 and fitting bore 280 will be axially aligned to permit extension of suction tube insert 272 therebetween. Specifically, second end 276 of insert 272 is sealingly slidably engaged within opening 232, as by a slip fit. An annular seal 284 is provided in the sidewall of opening 232 so that tube insert 272 may be inserted a selective depth into opening 232 while maintaining a proper seal. In this way, variations in radial spacing between crankcase 46 and central portion 14 of the housing may be compensated for.

With respect to rotational alignment of crankcase 46 such that tube insert 272 is axially received within fitting bore 280, mounting pin assembly 250 provides for a limited degree of rotational alignment. Compensation for misalignment between suction inlet opening 232 and fitting bore 280 along the axial direction with respect to compressor housing 12 is provided by the disclosed structure whereby flange 278 is retained within fitting bore 280. Flange 278 extends radially outwardly from insert 272 and is received between outer fitting member 266 and housing fitting member 264. Furthermore, an annular space 286 is provided between the outside diameter of flange 278 and the inside diameter of threaded nut 268. The combination of annular space 286 and annular clearance 282 permits random movement of tube insert 272 within bore 280, whereby the axis of insert tube 272 is substantially parallel to and selectively spaced relative to the axis of fitting bore 280. This freedom of motion of tube insert 272 within fitting bore 280 translates to approximately 0.100 inches of compensation for misalignment of suction inlet opening 232 and fitting bore 280 along the vertical axis of the housing.

Suction fitting assembly 252 further comprises a sealing arrangement whereby flange 278 is sealingly retained between housing fitting member 264 and outer fitting member 266. Specifically, an annular sealing ring 288 is interposed between sealing surface 290 of outer member 266, and flange 278. Likewise, an annular sealing ring 292 is interposed between a sealing surface 294 of housing member 264, and flange 278. Annular sealing rings 288, 292 are retained within grooves in sealing surfaces 290, 294, respectively. Accordingly, flange 278 is sealingly secured between housing fitting member 264 and outer fitting member 266 when threaded nut 268 draws the two members together.

Suction fitting assembly 252 further comprises a conical screen filter 296 including a mounting ring 298 at the base end thereof. Mounting ring 298 slip fits into a counterbore 300 provided in first end 274 of suction tube insert 272. In such an arrangement, filter 296 may be easily removed for cleaning or replacement.

FIG. 4 also shows a discharge fitting 302 provided in central portion 16 of housing 12 located directly beneath suction fitting assembly 252. The location of discharge fitting 302 in a central or lower portion of the housing provides an advantage in that the fitting acts as a dam and limits to about 20 lbs. the amount of refrigerant charge that will be retained by the compressor and required to be pumped out upon startup.

It will be appreciated that in practicing the discharge muffling system in accord with the present invention, it is desirable to maximize the volumes of top and bottom muffling chambers 158, 162, and to minimize the cross-sectional areas of interconnecting passageways 234 and annular exhaust port 172. In this way, constrictions are introduced between muffling chambers to improve sound muffling properties. At the same time, it is desirable to have the cross-sectional areas of bores 230, gas passageways 234, and annular exhaust port 172 approximately equal to avoid unnecessary pressure drops.

It will be appreciated that the foregoing is presented by way of illustration only, and not by way of any limitation, and that various alternatives and modifications may be made to the illustrated embodiment without departing from the spirit and scope of the invention.

What is claimed is:

1. A compressor assembly, comprising:

a hermetically sealed housing defining a discharge pressure space therein;

pressure space therein;

a crankcase within said housing, including a plurality of radially disposed cylinders formed therein, said crankcase including a cavity into which said plurality of cylinders open;

a crankshaft rotatably received in said crankcase and having a plurality of pistons operably connected thereto within said cavity, said pistons being operably received in respective said cylinders to compress gaseous refrigerant received therein;

a first muffling chamber and a second muffling chamber located on respective opposite axial ends of said crankcase, said second muffling chamber comprising an annular channel formed in said respective axial end, and a substantially planar, ring-shaped channel cover plate fixedly mounted to said respective axial end por ıon at one of a radially inner adjacent portion and a radially outer adjacent portion of said axial end with respect to said channel, said cover plate being biased in engagement with the other of said radially inner adjacent portion and said radially outer adjacent portion;

means for discharging gaseous refrigerant compressed within said plurality of cylinders into said first muffling chamber;

gas passage means extending through said crankcase for providing communication between said first muffling chamber and said second muffling chamber; and means for exhausting gaseous refrigerant from said second muffling chamber into said discharge pressure space, said means comprising an annular exhaust port defined by an annular space between said cover plate and said one of said radially inner adjacent portion and said radially outer adjacent portion.

2. The compressor assembly of claim 1 in which:

said gas passageway means comprises an axial bore extending between said first muffling chamber and said second muffling chamber through said crankcase at a radial location between adjacent said cylinders.

3. The compressor assembly of claim 1 and further comprising:

a plurality of valve plates closing respective said cylinders;

discharge valve means operably associated with each of said plurality of valve plates for discharging compressed gas from within said cylinder through a respective said valve plate; and a cylinder head cover associated with each of said plurality of cylinders and attached to said crankcase with a corresponding said valve plate interposed therebetween whereby a discharge space is formed by said valve plate and said head cover, said means for discharging comprising said discharge valve means, said discharge space, and a respective discharge passage communicating between each said discharge space and said first muffling chamber through said crankcase.

4. A compressor assembly, comprising:

a hermetically sealed housing having a discharge pressure space therein;

an electric motor operatively disposed within said housing and having a rotatable rotor;

a crankcase within said housing, including a plurality of radially disposed cylinders formed therein, said crankcase including a cavity into which said plurality of cylinders open;

a crankshaft rotatably connected to said rotor and operably journalled in said crankcase, said crankshaft having a plurality of pistons operably connected thereto within said cavity, said pistons being operably received in respective said cylinders to compress gaseous refrigerant received therein;

an annular channel formed in said crankcase on the outer surface thereof adjacent said motor, said channel comprising a radially inner wall and a radially inner wall and a radially outer wall, each of said radially inner wall and said radially outer wall having an outwardly facing top surface;

means for discharging gaseous refrigerant compressed within said plurality of cylinders into said channel;

a channel cover plate;

means for attaching said cover plate to said crankcase at the top surface of one of said radially inner wall and said radially outer wall such that said cover plate is biased in engagement with the top surface of the other of said radially inner wall and said radially outer wall; and means for exhausting gaseous refrigerant from said channel into said discharge pressure space, said means comprising an annular exhaust port defined by an annular space between said cover plate and the top surface of said one of said radially inner wall and said radially outer wall.

5. A compressor assembly, comprising:

a hermetically sealed housing having a discharge pressure space therein, said housing in its operative position having a top end and a bottom end;

a crankcase mounted within said housing and having a top surface and a bottom surface facing respective said top and bottom ends of said housing, said crankcase including a plurality of radially disposed cylinders formed therein, said crankcase also including an inner cavity into which said plurality of cylinders open;

an electric motor operatively disposed within said housing below said crankcase, said motor having a stator winding and a rotatable rotor;

a vertical crankshaft operably journalled in said crankcase and extending outwardly from said bottom surface thereof to rotatably connect with said rotor, said crankshaft having a plurality of pistons operably connected thereto within said cavity, said pistons being operably received in respective said cylinders to compress refrigerant received therein;

a first muffling chamber on said top surface of said crankcase;

means for discharging gaseous refrigerant compressed within said plurality of cylinders into said first muffling chamber;

an annular channel formed in the bottom surface of said crankcase surrounding said crankshaft, said channel comprising a radially inner wall, a radially outer wall, and a bottom wall said crankcase bottom surface having an inner annular ledge adjacent to and extending radially inwardly from said radially inner wall and having an outer annular ledge adjacent to and extending radially outwardly from said radially outer wall;

gas passage means extending through said crankcase for providing communication between said first muffling chamber and said annular channel;

a ring-shaped channel cover plate; and means for attaching said cover plate to said bottom surface of said crankcase such that said cover plate is fixedly mounted against one of said inner and outer ledge while being biased in engagement with the other of said inner and outer ledge, said attachment means including a plurality of circumferentially spaced spacers interposed between said cover plate and said ledge, whereby a substantially unimpeded annular port is provided for exhausting gaseous refrigerant from said second channel into said discharge pressure space adjacent said motor stator winding for cooling thereof.

6. The compressor assembly of claim 5 in which:

said cover plate is fixedly mounted against said inner ledge and is biased in engagement with said outer ledge, said spacers being interposed between said cover plate and said inner ledge.

7. The compressor assembly of claim 5 in which:

said gas passage means comprises an axial bore extending between said first muffling chamber and said channel through said crankcase at a radial location between adjacent said cylinders.

8. The compressor assembly of claim 5, and further comprising:

a plurality of valve plates closing respective said cylinders;

discharge valve means operably associated with each of said plurality of valve plates for discharging compressed gas from within said cylinder through a respective said valve plate; and a cylinder head cover associated with each of said plurality of cylinders and attached to said crankcase with a corresponding said cover plate interposed therebetween, whereby a discharge space is formed by said valve plate and said head cover, said means for discharging comprising said discharge valve means, said discharge space, and a respective discharge passage communicating between each said discharge space and said first muffling chamber through said crankcase.

9. The compressor assembly of claim 5 in which:

said cover plate comprises a bellville washer.

10. The compressor assembly of claim 5 in which:

said crankshaft extends axially outwardly from said bottom surface of said crankcase, said annular channel circumscribing said crankshaft on said bottom surface.

11. The compressor assembly of claim 5 in which:

said plurality of spacers comprise bosses on said cover plate.

12. The compressor assembly of claim 5 in which:

said plurality of spacers comprise washers.

13. The compressor assembly of claim 12 in which:

said means for attaching includes a plurality of bolts extending through corresponding holes in said cover plate and being received within corresponding threaded holes in said crankcase bottom surface, said bolts extending through said washers interposed between said cover plate and said crankcase bottom surface.

14. The compressor assembly of claim 12 in which:

said means for attaching comprises a plurality of rivets extending through respective holes in said cover plate and through respective washers interposed between said cover plate and said crankcase bottom surface to which said rivets are attached.

15. A compressor assembly, comprising:

a hermetically sealed housing having a discharge pressure space therein;

an electric motor operatively disposed within said housing and having a rotatable rotor;

a crankcase within said housing, including a cylinder formed therein, said crankcase including a cavity into which said cylinder opens;

a crankshaft rotatably connected to said rotor and operably journalled in said crankcase, said crankshaft having a piston operably connected thereto within said cavity, said piston being operably received in said cylinder to compress gaseous refrigerant received therein;

an annular channel formed in said crankcase on the outer surface thereof adjacent said motor, said channel comprising a radially inner wall and a radially outer wall, each of said radially inner wall and said radially outer wall having an outwardly facing top surface, said radially inner wall top surface and said radially outer wall top surface being defined in parallel offset planes, and one of said radially inner and said radially outer wall top surfaces being recessed in said crankcase outer surface with respect to the other one of said radially inner wall and said radially outer wall top surfaces;

means for discharging gaseous refrigerant compressed within said cylinder into said channel;

a substantially planar channel cover plate; and means for attaching said cover plate to said crankcase at the top surface of one of said inner and said outer walls such that said cover plate is biased in engagement with the top surface of the other of said inner and said outer walls, said means for attaching comprising attachment of said cover plate to said recessed top surface.

16. The compressor assembly of claim 15 in which:

said crankshaft extends axially outwardly from said outer surface of said crankcase, said annular channel circumscribing said crankshaft on said outer surface.

17. The compressor assembly of claim 15 in which:

said means for discharging includes a first muffling chamber on the top outer surface of said crankcase axially opposite said motor, and said channel and said cover plate comprise a second muffling chamber, whereby two stage muffling is provided.

18. A compressor assembly, comprising:

a hermetically sealed housing having a discharge pressure space therein;

an electric motor operatively disposed within said housing and having a rotatable rotor;

a crankcase within said housing, including a cylinder formed therein, said crankcase including a cavity into which said cylinder opens;

a crankshaft rotatably connected to said rotor and operably journalled in said crankcase, said crankshaft having a piston operably connected thereto within said cavity, said piston being operably received in said cylinder to compress gaseous refrigerant received therein;

an annular channel formed in said crankcase on the outer surface adjacent said motor, said channel comprising a radially inner wall and a radially outer wall, each of said radially inner wall and said radially outer wall having an outwardly facing top surface, said radially inner wall top surface and said radially outer wall top surface being substantially coplanar;

means for discharging gaseous refrigerant compressed within said cylinder into said channel;

a dish-shaped channel cover plate;

means for attaching said cover plate to said crankcase at the top surface of one of said inner and said outer walls such that said cover plate is biased in engagement with the top surface of the other of said inner and said outer walls, said means for attaching comprising attachment of said cover plate at a raised central portion thereof to said radially inner wall top surface such that an outer circumferential edge of said cover plate is biased in engagement with said radially outer wall top surface.

19. The compressor assembly of claim 18 in which said cover plate comprises a belliville washer.

* * * * *

UNITED STATES PATENT AND TRADEMARK OFFICE

CERTIFICATE OF CORRECTION

PATENT NO. : 4,842,492

DATED : June 27, 1989

INVENTOR(S) : Edwin L. Gannaway

It is certified that error appears in the above-identified patent and that said Letters Patent is hereby corrected as shown below:

On the title page:

In the Abstract, line 7, change "them" to --then--;

Claim 1, Col. 11, line 14, delete in its entirety;

Claim 4, Col. 12, line 23, delete "and a";

Claim 4, Col. 12, line 24, delete "radially inner wall";

Claim 5, Col. 12, line 63, after "compress" insert --gaseous--;

Claim 19, Col. 16, line 13, change "belliville" to --bellville--

Signed and Sealed this

Twenty-fourth Day of April, 1990

*Attest:*

HARRY F. MANBECK, JR.

*Attesting Officer*

*Commissioner of Patents and Trademarks*